US006125599A

United States Patent [19]

Mees et al.

[11] Patent Number: 6,125,599

[45] Date of Patent: Oct. 3, 2000

[54] DOOR SILL WITH FLANGES FOR ATTACHMENT TO JAMBS

[75] Inventors: Michael R. Mees; Bruce L. Mees, both of Frankfort; John T. Green, Blacklick, all of Ohio

[73] Assignee: Durable Products Company, Inc., Frankfort, Ohio

[21] Appl. No.: 09/136,774

[22] Filed: Aug. 19, 1998

[51] Int. Cl.[7] ..... E06B 1/34

[52] U.S. Cl. ..... 52/204.5; 52/211; 52/212; 52/208; 52/716.2

[58] Field of Search ..... 52/204.5, 208, 52/211, 212, 716.2, 717.01, 717.04, 204.1; 49/476.1, 483.1, 489.1, 490.1

[56] References Cited

U.S. PATENT DOCUMENTS

| | | | |
|---|---|---|---|
| 794,953 | 7/1905 | Stevenson . | |
| 2,696,028 | 12/1954 | Miller . | |
| 2,875,481 | 3/1959 | Erkkila . | |
| 2,939,188 | 6/1960 | Wahlfeld | 52/211 X |
| 3,208,564 | 9/1965 | Sitterly | 52/211 X |
| 3,521,404 | 7/1970 | Hager et al. | 49/489.1 X |
| 3,654,734 | 4/1972 | Lehman | 52/212 X |
| 4,922,661 | 5/1990 | Dallaire et al. | 49/476.1 X |
| 5,611,173 | 3/1997 | Headrick et al. . | |
| 5,838,118 | 11/1998 | Thornton et al. | 52/211 X |

FOREIGN PATENT DOCUMENTS

| | | | |
|---|---|---|---|
| 87464 | 9/1959 | Denmark | 49/483.1 X |

*Primary Examiner*—Carl D. Friedman
*Assistant Examiner*—Phi Dieu Tran A
*Attorney, Agent, or Firm*—Frank H. Foster; Kremblas, Foster, Millard & Pollick

[57] ABSTRACT

A door sill has a plastic, or other water impervious, plank fastened on its underside. The bottom of the plank seats against the subfloor of a building. The ends of the plank protrude beyond the rest of the sill, forming short flanges under the lower ends of the attached door jambs. The jambs are fastened to the sill, and the flanges are fastened to the jambs, by nails, screws or staples. The plank is water impervious, thereby preventing rot of the jambs by water wicking up to, and into, the jambs. The plank also raises the sill, and therefore the entire door frame, up by the thickness of the plank, which keeps the bottom of the door from scraping against the upper surface of a finish floor material, such as carpet.

20 Claims, 2 Drawing Sheets

DOOR SILL WITH FLANGES FOR ATTACHMENT TO JAMBS

BACKGROUND OF THE INVENTION

1. Field of the Invention

This invention relates generally to door sills, which are commonly referred to as thresholds, and specifically to a structural component of the sill for mounting door jambs at opposite ends of the sill.

2. Description of the Related Art

Door sills have been used for many years to seal the bottoms of swinging residential doors when they are in the closed position. Sills originally consisted of multiple parts, including separate sill and threshold portions. This distinction in parts arose from the different functions the parts performed when door frames were constructed on site.

In the past when a door frame was being constructed, the carpenter fastened the door jambs in place on opposite sides of an opening roughly framed in a wall. Subsequently, an upper cross piece was fastened between the upper ends of the jambs, and then the sill was placed against the floor between the lower ends of the jambs. Once the sill was in place, the threshold was fastened onto the sill, and then the door was hung by fastening it to one of the jambs.

Improvements were made to sills which were to be fastened in place when the doorframe was constructed on site. Miller, in U.S. Pat. No. 2,696,028, discloses a door sill which extends out of an exterior wall. Erkkila, in U.S. Pat. No. 2,875,481, shows a similar sill which has similar advantages. Stevenson, in U.S. Pat. No. 794,953 and Headrick et al., in U.S. Pat. No. 5,611,173, show improvements in door sills.

Since the late 1960's and early 1970's, virtually all door frames constructed in the United States have been pre-hung, i.e. premanufactured prior to delivery to a construction site. In manufacturing facilities, a pair of door jambs are mounted to a sill and an upper door frame member to form a door frame. Typically, the sill has an extruded aluminum sill frame with a wooden plank attached in a cavity in the underside thereof. During manufacture, the lower, inner sides of the door jambs are seated against the ends of the sill and the lower ends are aligned flush with the lowermost extreme face of the sill. Then nails, staples or screws are fastened through the outside jamb edge into the sill's wooden plank. A cross member is then fastened in place between the upper ends of the jambs and the door is mounted in the frame. The entire unit is then transported to the construction site where it is fastened in a rough door opening. The Erkkila and Miller sills could not be used in the pre-hung door process without significant alterations to the sills and the frame members attached to the sills.

One disadvantage with a pre-hung door is the tendency of the frame to become misaligned with the door due to weaknesses in the joints at the corners of the frame. Because the door has outside corners which are at 90 degree angles, the frame should have inside corners which are at 90 degree angles. In order for the door to open and close properly, there must be sufficient gaps between all four outer door edges and the inner edges of the adjacent frame members. When the door frame corners are not at 90 degree angles due to weaknesses in the corner joints, the gaps between the door and the frame becomes too small for door movement. This misalignment requires door removal and trimming or complete replacement of the door and frame.

A second disadvantage with pre-hung doors is the tendency of the jambs to rot due to water contact. The lower ends of the wooden jambs are aligned with the lowest extreme of the sill in order to maximize the area of contact between the door jamb and the sill end, which maximizes the joint's strength. However, this often has a negative result. The lower ends of the jambs touch the subfloor of the door opening, which permits any water that comes into contact with the lower ends of the jambs to wick up into the jambs. The grain of the wooden jamb is aligned along the jamb's length, which permits this wicking of water to occur by capillary action.

Therefore, the need exists for a door sill or frame which is strong, and which prevents wicking of water from the subfloor to the jambs.

BRIEF SUMMARY OF THE INVENTION

The invention is an improved elongated door sill. The sill has an upper crown surface extending laterally to opposite sides, and extending longitudinally to opposite first and second ends. Each sill end is configured for mounting to a lower end of one of a pair of door jambs having a predetermined thickness. The improvement comprises a first water impervious flange mounted near a first end of the door sill. The first flange extends to a terminal flange end spaced from the sill's first end a distance substantially equal to a jamb's thickness. A second water impervious flange is mounted to a second, opposite end of the door sill. The second flange extends to a terminal end spaced from the sill's second end a distance substantially equal to a jamb's thickness.

The invention also contemplates a door frame. The door frame comprises an elongated door sill having an upper crown surface extending laterally to opposite sides, and extending longitudinally to opposite first and second ends. A first jamb has a predetermined thickness and a lower end including an outer edge. The first jamb has an opposite, inner edge mounted against the first end of the door sill. A second jamb has a predetermined thickness and a lower end including an outer edge. The second jamb has an opposite, inner edge mounted against the second end of the door sill. A first water impervious flange is attached to a lower face of the sill near the first end of the door sill. The flange extends beneath, and mounts to, the lower end of the first jamb. The flange has a terminal flange end which extends no further than substantially the outer edge of the first jamb. A second water impervious flange is attached to the lower face of the sill near the second end of the door sill. The flange extends beneath, and mounts to, the lower end of the second jamb. The second flange has a terminal flange end which extends no further than substantially the outer edge of the second jamb.

Figure 1:
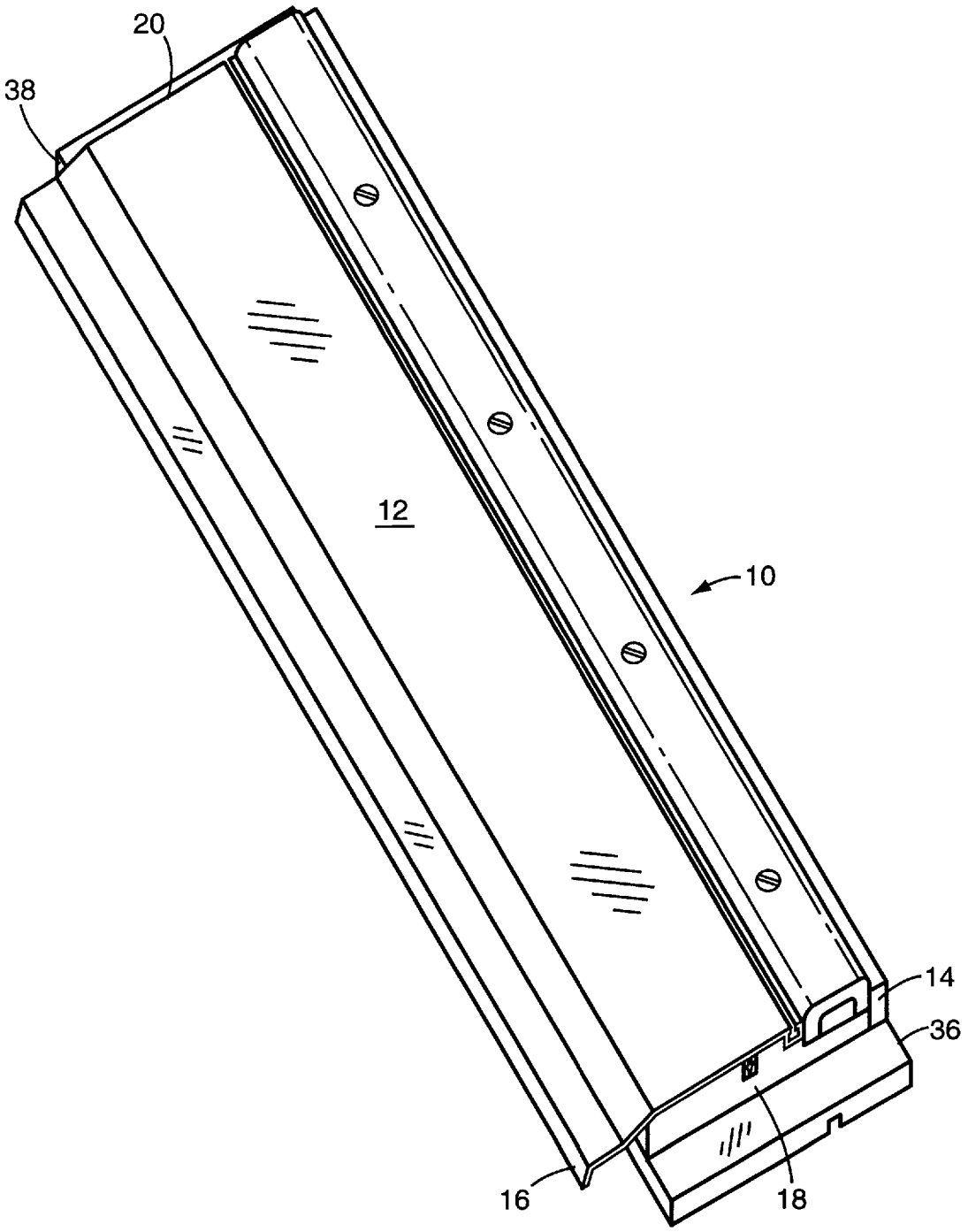
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

The preferred sill 10 is shown in FIG. 1. The crown portion 12 is the upper surface which extends laterally to an interior side 14 and an opposite exterior side 16. When the sill 10 is attached in its operable position, the interior side 14 faces indoors into a house, and the exterior side 16 faces outdoors. The crown portion 12 extends longitudinally from a right end 18 to an opposite left end 20. The references "left" and "right" indicate the relative positions of the ends of the sill when the sill is viewed facing the exterior side 16.

Figure 2:
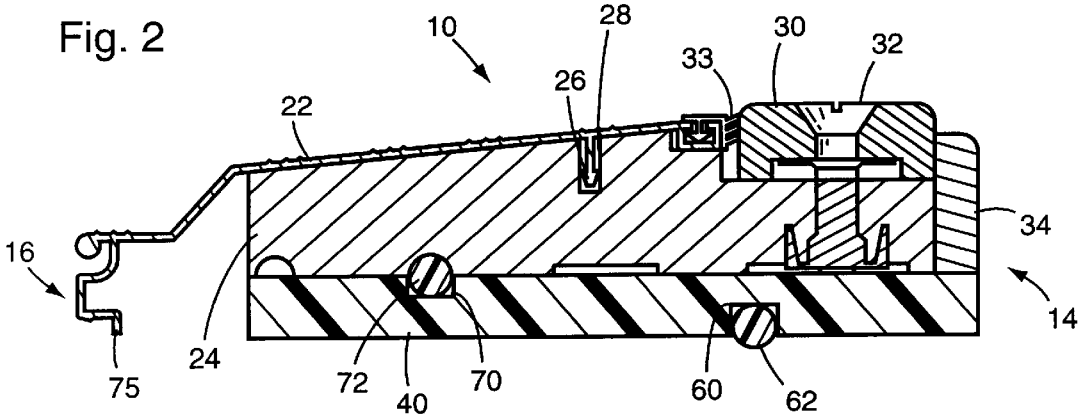
FIG. 2 is an end view illustrating the preferred embodiment.
Figure 3:
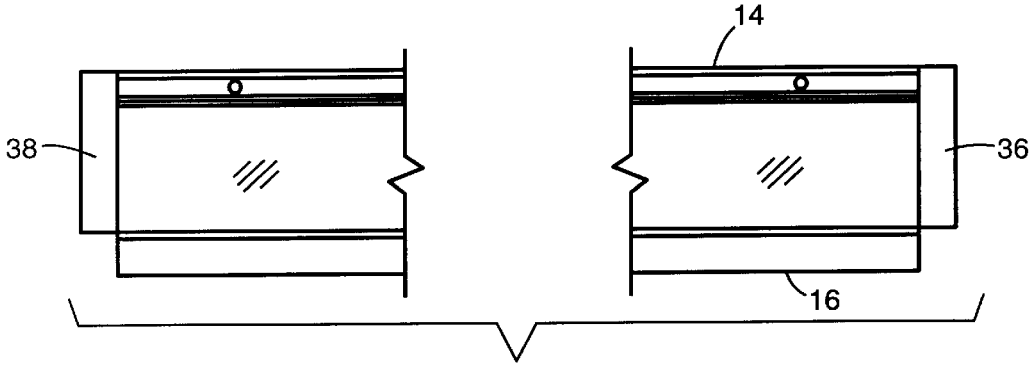
FIG. 3 is a top view illustrating the preferred embodiment.

Referring to FIG. 2, the preferably extruded aluminum tread 22 has a cavity beneath it into which a preferably wooden plank 24 is mounted. A barbed rib 26 extends from the tread 22 into a groove 28 in the wooden plank 24 to mount the tread 22 to the wooden plank 24. A threshold member 30 is mounted to the wooden plank 24 by a plurality of screws 32. A flexible seal 33 is mounted to the lateral edge of the tread 22, spanning and sealing the gap between the tread 22 and the threshold member 30. A trim strip 34, the exposed lateral surface of which forms the interior side 14, is fastened to the edge of the wooden plank 24, preferably by staples or nails.

The above described structure, if used alone, would be susceptible to rot, and would not have the rigidity required to maintain the frame square at the corners. This structure is not used alone, however. A water impervious plate, preferably the rigid plastic plank 40, is mounted to the lower face of the wooden plank 24 preferably by staples or nails extending through the bottom surface of the plastic plank 40 upwardly into the wooden plank 24. Of course, screws, adhesives or any other suitable fastener could be substituted for the preferred fastener.

The plastic plank 40 preferably has stiffness and other characteristics similar to wood, and is therefore able to receive nails, screws and equivalent fasteners. However, the plastic plank 40 is water impervious; that is, water is not transported through the plank from one side to the other under normal conditions. Of course, the plastic plank 40 could be substituted by a plank made of a laminated structure with water impervious layers laminated between water pervious layers, or a different, equivalent material with characteristics making it suitable for use with the present invention.

The plastic plank extends longitudinally preferably the entire length of the wooden plank 24 with short portions of the opposite ends of the plastic plank 40 protruding beyond the wooden plank 24 forming flanges 36 and 38 (see FIG. 1). In general, the length of the flanges 36 and 38 is preferably substantially equal to the thickness of the jambs that will be fastened to the opposite ends of the sill 10. The length of the flanges 36 and 38 is described next in more detail.

Figure 4:
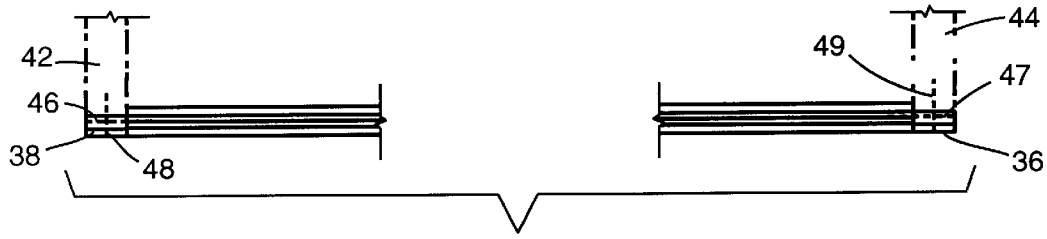
FIG. 4 is a side view illustrating the preferred embodiment.

The primary advantage of the flanges is the protection of the door jambs by the flanges. As can be seen in FIG. 4, the lower edges of the door jambs 42 and 44 rest upon the upper surfaces of the flanges 38 and 36, respectively. Because the flanges are made of a water impervious material, they do not transport water from the subfloor, upon which the sill rests, up to the lower ends of the jambs. Therefore, water on the subfloor cannot wick up the door jambs to cause rot. The flanges are at least about one-quarter of an inch thick to prevent deeper water from flowing over the plank. The flanges prevent water from wicking up into the wooden plank 24 (shown in FIG. 2), too. The rot prevention the flanges provide is a significant improvement over conventional pre-hung door sills.

As discussed above, the distance the flanges protrude beyond the ends of the sill is substantially equal to the thickness of the jambs. The flanges extend beneath the jambs, and the terminal ends of the flanges protrude in the longitudinal direction no significant distance beyond the outer edges of the jambs. Therefore, when the lower ends of the jambs rest upon the upper surfaces of the flanges, substantially all horizontal flange surfaces are covered by the jambs. The advantageous result of this structure is that water cannot strike any horizontal flange surface and flow under the lower ends of the jambs, because all horizontal flange surfaces are covered by the jambs. Any water striking any surface near the flange merely runs down past the flange.

In the preferred embodiment, the width of the flanges is substantially equal to the width of the door jambs attached to them. The plastic plank 40 extends laterally from substantially flush with the interior side 14 to flush with the opposite, exterior edge of the wooden plank 24. The plastic plank 40 could extend beyond the wooden plank 24 to the inner surface of the exterior side 16. It is of course also possible for the flanges to be wider than the door jambs connected to them. However, any extra width will not permit water to flow under the jamb, because it will eventually be covered by molding, such as brick molding. Any horizontal surface of the flanges which extends laterally beyond the jamb will be substantially covered before the home is completed in order to prevent water from striking the horizontal flange surface and running under the jambs. The flanges will never extend beyond the interior side 14 or the exterior side 16 of the sill.

In addition to the rot prevention of the present invention, the strength of the resulting door frame is enhanced with the present invention. The lower ends of door jambs 42 and 44 seat against the upper surfaces of the flanges 36 and 38, and the inner edges of the jambs 42 and 44 seat against the opposite ends of the wooden plank 24. This joint has a large area of contacting surfaces, which is advantageous due to its strength. If an adhesive is used, the large surface area will enable the joint to have significant strength. Even if fasteners, such as nails, are used alone, the abutting of one flat face against more than one other flat face will provide a strong joint, suggesting that the joined pieces will maintain their original relative positions under stress.

In the preferred embodiment, the horizontal nails 46 and 47 (shown in hidden lines) are directed inwardly from the outer edges of the jambs 42 and 44, respectively, through the jambs and into the corresponding ends of the wooden plank 24. The vertical nails 48 and 49 (shown in hidden lines) are directed upwardly from the lower surfaces of the flanges 38 and 36, respectively, through the flanges and into the lower ends of the jambs 42 and 44, respectively. Because each of the nails in each nail pair 46 and 48, and 47 and 49, is oriented at 90 degrees to the other, the holding power of the joint between the jambs, flanges and wooden plank is significantly greater than the conventional joint in which the jambs are merely side nailed into a wooden plank. With the joint using the flanges, if a jamb is pulled upwardly or outwardly from the sill, one of the nails 46–49 is exposed to a shear force, which nails can sustain very well.

In addition to the advantage in structural rigidity, the present invention provides a significant additional advantage. Doors built with conventional sills have a problem with scraping thick finish floor surfaces. The flanges, which are preferably at least about one-quarter of an inch and not greater than about three-eighths of an inch thick, raise the sill and the rest of the door frame above the subfloor on which it rests. Raising the door frame raises the bottom of the door. Because the lower edge of the door is raised by the flanges, the door built with a sill having the preferred flanges will be certain to pass over carpet or other thick finish flooring without scraping against the upper surface of the flooring.

It is important that the door frame not be raised by an amount greater than a standard rough door opening will permit. The distance the flanges raise the door frame is equal to the thickness of the flanges, and therefore the flanges could be about three-eighths inch maximum. If the standard rough door opening increases or decreases, then the maximum flange thickness will increase or decrease accordingly.

The sill drop 75 (see FIG. 2) is preferably an integral part of the tread 22, and extends downwardly to align flush with the bottom surface of the plank 40. The sill drop 75 is designed to have a corresponding height relationship with the plank 40 so that the sill drop's lower edge is flush with the bottom surface of the plank 40. If a sill is made with a plank that is thinner or thicker than the plank 40 shown in FIG. 2, the sill drop should be shorter or taller, respectively, than the sill drop 75 shown in FIG. 2. When installed, the bottom surface of the plank 40 rests upon the subfloor, and the lower edge of the sill drop 75 rests upon that subfloor surface, too. If desired, a caulking material can be applied to seal the joint between the sill drop 75 and the subfloor.

The preferred embodiment includes a single plank forming flanges where it protrudes beyond opposite ends of the sill. The single plank could, as is implied by the term "flanges," comprise two separate planks, one fastened at one end of the sill, and the other fastened at the opposite end of the sill. This would provide some of the rot prevention advantages described above, but would be less desirable for several reasons.

First, discontinuous flanges would leave an opening through which air, water and insects could enter at least the underside of the sill, if not the home. With the continuous plank, this problem is avoided.

Secondly, a discontinuous flange embodiment would not have the strength of the single plank structure. For example, upon the application, during shipping, of an upward force to both flanges, each flange would tend to pull out of the underside of the sill. With a single plank, the connecting portion of the plank prevents such problems.

Thirdly, during manufacture of the sill, the single plank must be held in place while it is mounted to the sill. With two planks, there would be two pieces to hold in place during mounting to the sill. This would require additional time to manufacture, and it would make the likelihood of misalignment greater.

A single, continuous plank also provides a structure in which another advantageous feature can be formed: a groove in the bottom of the plank into which a sealing gasket may be mounted. The groove 60 (shown in FIG. 2) allows for a polymer foam gasket 62, which is commonly referred to as a foam backed rod, to be held firmly in the underside of the plastic plank 40. While a door frame is being installed, the installer often forgets to put a bead of caulk sealant on the bottom of the sill to prevent air, water and insects from coming under the door after it is in place. The gasket material is a fail-proof seal between the subfloor and the sill for the times installers forget to caulk beneath the sill.

A second gasket 72 is preferably held in the second groove 70 formed in the upper surface of the plank 40. The gasket 72 seals the joint between the plastic plank 40 and the wooden plank 24, preventing air, moisture and insects from entering the house through this joint. The gasket 72 is preferably substantially identical to the gasket 62.

The wooden plank 24 (shown in FIG. 2) could be substituted by any other material or structure which will receive fasteners that attach the jambs to the sill. Wood is preferred because screws, nails and staples can be inserted into, and hold tight within, wood. However, plastics, composites and other materials will work if conventional fasteners can be used to fasten the door jambs to the sill. Additionally, if the sill tread is made of extruded material, such as aluminum, structures can be formed on the underside of the tread that will accept screws. Such structures are U-shaped in section, and extend downwardly from the underside of the tread, to form an elongated channel into which a screw's threaded shaft can extend. The threads of the screw cut into the channel walls as the walls expand to permit the screw shaft to be inserted. Such structures are known as "boss screws."

While certain preferred embodiments of the present invention have been disclosed in detail, it is to be understood that various modifications may be adopted without departing from the spirit of the invention or scope of the following claims.

What is claimed is:

1. An improved elongated door sill having an upper crown surface extending laterally to opposite sides, and extending longitudinally to opposite first and second sill ends, each sill end having a surface for seating against and attaching to a lower end of first and second door jambs having a predetermined jamb width and thickness, the improvement comprising:

(a) a first water impervious flange mounted near a first sill end, said first flange extending longitudinally from beneath the first sill end, said flange having a uniform, continuous flange surface extending to a flange end spaced from the first sill end a distance substantially equal to the predetermined jamb thickness for extending beneath the first door jamb no further than an outer edge of the first lamb; and (b) a second water impervious flange mounted near an opposite, second sill end, said second flange extending longitudinally from beneath the second sill end in a direction substantially opposite to the first flange, said flange having a uniform, continuous flange surface extending to a flange end spaced from the second sill end a distance substantially equal to the predetermined jamb thickness for extending beneath the second door jamb no further than an outer edge of the second jamb.

2. An improved door sill in accordance with claim 1, wherein the flanges have a width substantially equal to the predetermined jamb width.

3. An improved door sill in accordance with claim 1, wherein the flanges have a predetermined thickness of at least about one-quarter of an inch.

4. An improved door sill in accordance with claim 3, wherein the flanges have a predetermined thickness of no more than about three-eighths of an inch.

5. An improved door sill in accordance with claim 1, wherein the sill further comprises a tread having an underside against which a wooden plank is mounted, and wherein said flanges extend laterally from substantially an interior side of said sill, near an interior side of said wooden plank, to substantially an opposite side of said wooden plank.

6. An improved door sill in accordance with claim 5, further comprising a sill drop formed on the tread near an exterior side of said sill, said sill drop extending to substantially flush with a subfloor-engaging surface of the water impervious flange.

7. An improved door sill in accordance with claim 5, wherein said flanges are formed by opposite longitudinal ends of a water impervious plank attached against a lower surface of the sill, and extending along the entire length of the sill.

8. An improved door sill in accordance with claim 7, further comprising an elongated groove, formed in a subfloor-engaging surface of the water impervious plank, into which an elongated gasket member is mounted, leaving at least a portion of the gasket member protruding from the groove.

9. An improved door sill in accordance with claim 7, further comprising a second elongated groove, formed in a sill-engaging surface of the water impervious plank, into which a second elongated gasket member is mounted.

10. An improved door sill in accordance with claim 1, wherein said sill ends can receive and retain fasteners inserted therein.

11. An improved door sill in accordance with claim 1, wherein said water impervious flanges further comprise at least one layer of water impervious material.

12. A door frame comprising:

(a) an elongated door sill having an upper crown surface extending laterally to opposite sides, and extending longitudinally to opposite first and second sill ends;

(b) a first jamb having a predetermined width and thickness and a lower end including an outer edge, and an opposite, inner edge seating against and attaching to the first sill end;

(c) a second jamb having a predetermined width and thickness and a lower end including an outer edge, and an opposite, inner edge seating against and attaching to the second sill end;

(d) a first water impervious flange attached to a lower face of the sill near the first sill end, said flange extending longitudinally from beneath the first sill end and mounting to the lower end of the first jamb, said flange having a uniform, continuous flange surface which extends beneath the jamb no further than substantially the outer edge of the first jamb; and (e) a second water impervious flange attached to the lower face of the sill near the second sill end, said flange extending longitudinally from beneath the second sill end in a direction substantially opposite to the first flange and mounting to the lower end of the second jamb, said second flange having a uniform, continuous flange surface which extends beneath the lamb no further than substantially the outer edge of the second jamb.

13. A door frame in accordance with claim 12, further comprising fasteners extending from the door jambs to the sill, and from the flanges to the door jambs.

14. A door frame in accordance with claim 12, wherein the flanges have a thickness of at least about one-quarter of an inch, and no more than about three-eighths of an inch.

15. A door frame in accordance with claim 12, wherein the flanges have a width substantially equal to the predetermined jamb width.

16. A door frame in accordance with claim 15, wherein the sill further comprises a tread having an underside against which a wooden plank is mounted, and wherein said flanges extend laterally from substantially an interior side of said sill, near an interior side of said wooden plank, to substantially an opposite side of said wooden plank.

17. A door frame in accordance with claim 16, further comprising a sill drop formed on the tread near an exterior side of said sill, said sill drop extending to substantially flush with a subfloor-engaging surface of the water impervious plank.

18. A door frame in accordance with claim 16, wherein said flanges are opposite longitudinal ends of a water impervious plank attached against the lower face of the sill, and extending along the entire length of the sill.

19. A door frame in accordance with claim 18, further comprising an elongated groove, formed in a subfloor-engaging surface of the water impervious plank, into which an elongated gasket member is mounted, leaving at least a portion of the gasket member protruding from the groove.

20. A door frame in accordance with claim 19, further comprising a second elongated groove, formed in a sill-engaging surface of the water impervious plank, into which a second elongated gasket member is mounted.

* * * * *